United States Patent [19]

Sugawara et al.

[11] Patent Number: 4,570,533

[45] Date of Patent: Feb. 18, 1986

[54] FLUID DEFLECTING ASSEMBLY

[75] Inventors: Norio Sugawara; Motoyuki Nawa, both of Nara, Japan

[73] Assignee: Matsushita Electric Industrial Co., Ltd., Kodoma, Japan

[21] Appl. No.: 661,175

[22] Filed: Oct. 15, 1984

[30] Foreign Application Priority Data

| | | | |
|---|---|---|---|
| Oct. 13, 1983 | [JP] | Japan | 58-191142 |
| Dec. 23, 1983 | [JP] | Japan | 58-246026 |
| Mar. 16, 1984 | [JP] | Japan | 59-51427 |
| Apr. 18, 1984 | [JP] | Japan | 59-77982 |

[51] Int. Cl.[4] ..... F24F 13/14

[52] U.S. Cl. ..... 98/40.24; 98/40.12; 98/40.17; 137/601; 239/509; 239/513; 239/DIG. 7

[58] Field of Search ..... 98/2, 2.05, 36, 40.01, 98/40.12, 40.17, 40.18, 40.24, 40.26; 239/502, 507, 509, 513, DIG. 7; 137/599, 601; 138/40

[56] References Cited

U.S. PATENT DOCUMENTS

| | | | |
|---|---|---|---|
| 2,268,014 | 12/1941 | Bridges | 98/40.24 |
| 2,684,690 | 7/1954 | Lee | 98/40.18 X |
| 3,358,577 | 12/1967 | Thomson | 98/40.01 |

FOREIGN PATENT DOCUMENTS

| | | | |
|---|---|---|---|
| 149628 | 1/1953 | Australia | 239/502 |
| 57-19542 | 2/1982 | Japan | 98/40.24 |

*Primary Examiner*—Harold Joyce

*Attorney, Agent, or Firm*—Wenderoth, Lind & Ponack

[57] ABSTRACT

A fluid deflecting assembly comprising a passage defining structure having a fluid passage defined therein for the passage of a fluid stream in one direction therethrough and having a fluid inlet and a fluid exit spaced apart from the fluid inlet, and at least one group of deflector blades pivotally supported within the passage defining structure adjacent the fluid exit for movement through a predetermined angle and arranged in such a curved row that, when the deflector blades are pivoted in one direction to a deflecting position, the deflecting blades altogether form a generally continuously curved guide wall extending within the passage defining structure so as to diverge away from the direction of flow of the fluid stream through the passage. The guide wall is operable to draw the fluid stream close thereto to deflect the fluid stream as a whole by the Coanda effect known per se as it emerges outwards from the fluid exit.

13 Claims, 15 Drawing Figures

FLUID DEFLECTING ASSEMBLY

BACKGROUND OF THE INVENTION

The present invention generally relates to a fluid exit grille structure in an air-conditioner or a forced warm air heating appliance and, more particularly, to a fluid deflecting assembly in the fluid exit grille structure.

In general, in the conventional air-conditioner of a type particularly having a heat pump capability, a stream of fluid medium emerging from the fluid exit grille structure can be adjusted in two directions one at a time. Specifically, since the specific gravity of air changes with temperature, it is a recommended practice to allow the exit grille structure to blow the fluid medium upwardly or frontwardly of the exit grille structure where the fluid medium is cooled, or downwardly where the fluid medium is heated, by the reason well known to those skilled in the art.

In addition, regardless of whether the fluid medium emerging from the exit grille structure is heated or whether it is cooled, some of the conventional air-conditioners are provided with a fluid deflecting assembly incorporated in the exit grille structure for deflecting the flow of the fluid medium, emerging from the exit grille structure, in a direction laterally of the exit grille structure. An example of the prior art fluid deflecting assembly is schematically shown in FIGS. 1 and 2 of the accompanying drawings, in top sectional view and front elevational view, respectively.

Referring to FIGS. 1 and 2, the prior art fluid deflecting assembly comprises a passage defining structure 10 of generally rectangular cross-section having top and bottom walls 12 and 14 and a pair of opposite side walls 16 and 18 all assembled together so as to define a fluid passage 20 within the structure 10. The structure 10 has a fluid inlet 22, defined at a rear end thereof in communication with the passage 20, and a fluid exit 24 defined at a front end thereof in communication with the passage 20 and in opposition to the fluid inlet 22. The passage defining structure 10 is of such a design that the ratio of the height H relative to the width W, that is, the aspect ratio H/W, is small.

The fluid deflecting assembly also comprises a plurality of pivotable deflector blades 8 of generally rectangular plate-like configuration arranged in side-by-side and equally spaced relation to each other in a direction transversely of the passage 20 while extending between the top and bottom walls 12 and 14. These deflector blades 8 are supported by respective pivot shafts 6 for simultaneous pivotal movement between first and second positions past an intermediate position.

The prior art fluid deflecting assembly of the construction described with reference to and shown in FIGS. 1 and 2 operates in such a manner that, when and so long as the deflector blades 8 are held in the intermediate position, shown by the solid lines in FIG. 1, wherein all of the deflector blades 8 are aligned with the direction of the incoming air flowing through the passage 20, the air can emerge generally straight forwards from the fluid exit 24, but when and so long as the deflector blades 8 are swung to one of the first and second positions from the intermediate position, for example, to the first position as shown by the phantom lines, the incoming air ready to emerge outwards from the fluid exit 24 is forced to impinge upon the deflector blades 8 to deflect in one direction laterally of the passage defining structure 10, for example, leftwards as viewed in FIG. 1, as it emerges outwards from the fluid exit 24. In this design, when the deflector blades 8 are in any one of the first and second positions, the space defined between each adjacent two deflector blades 8, shown by w in FIG. 1, is reduced to a value smaller than that defined when the deflector blades 8 are in the intermediate position, and therefore, the flow of the air emerging outwards from the deflecting assembly as a whole is smaller when the deflector blades 8 are in any one of the first and second positions than when they are in the intermediate position. In view of this, the available deflecting angle $\theta$, that is, the angle of deflection of the air flowing leftward or rightward when the deflector blades 8 are in the first or second position relative to the direction of straight forward flow of the air taking place when the deflector blades 8 are in the intermediate position, is limited to about 30°.

Accordingly, where the air-conditioner equipped with the prior art fluid deflecting assembly of the construction described above is installed at a corner area of a house room to be air-conditioned, the greater the deflecting angle, the larger the coverage of the air-conditioner, and however, in view of the limited deflecting angle discussed above the air-conditioner is unable to cover a relatively large space.

SUMMARY OF THE INVENTION

The present invention has for its essential object to provide an improved fluid deflecting assembly which comprises at least one group of pivotably supported deflector blades arranged in such a row that, when swung to one of the two positions spaced angularly from each other about the axis of pivot of each deflector blade, the deflector blades form a generally continuously curved wall extending in the passage defining structure so as to diverge outwardly away from the main stream of air flowing through the passage defining structure so that the air flowing along the curved wall can be deflected by the Coanda effect.

According to the present invention, because of the utilization of the Coanda effect, the increased deflecting angle can be obtained.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENT

Figure 1:
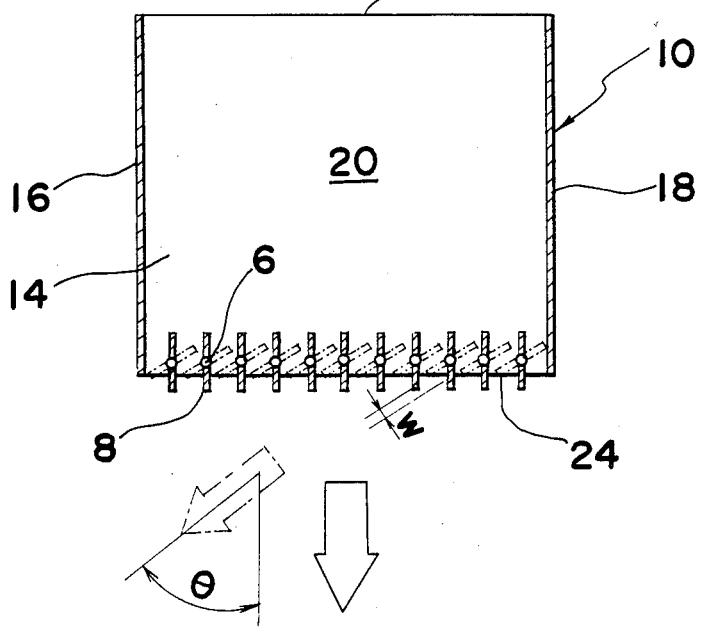
Fig. 1 Prior Art
FIG. 1 is a schematic top sectional view of the prior art fluid deflecting assembly.
Figure 2:
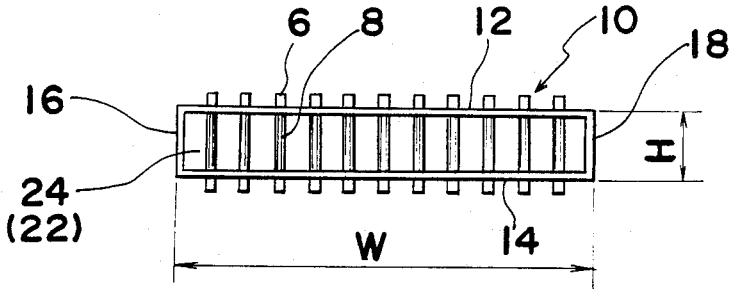
Fig. 2 Prior Art
FIG. 2 is a schematic front elevational view of the prior art fluid deflecting assembly shown in FIG. 1.

Before the description of the present invention proceeds, it is to be noted that like parts are designated by like reference numerals throughout the accompanying drawings.

Figure 3:
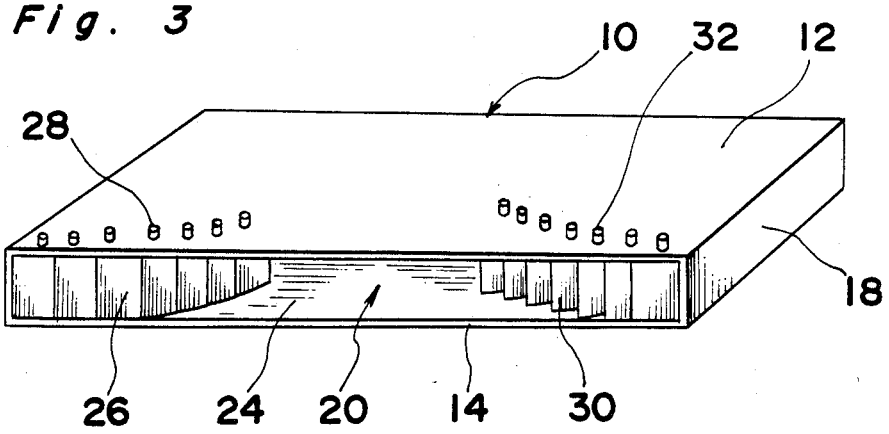
FIG. 3 is a perspective view of a fluid deflecting assembly according to a first preferred embodiment of the present invention.
Figure 4:
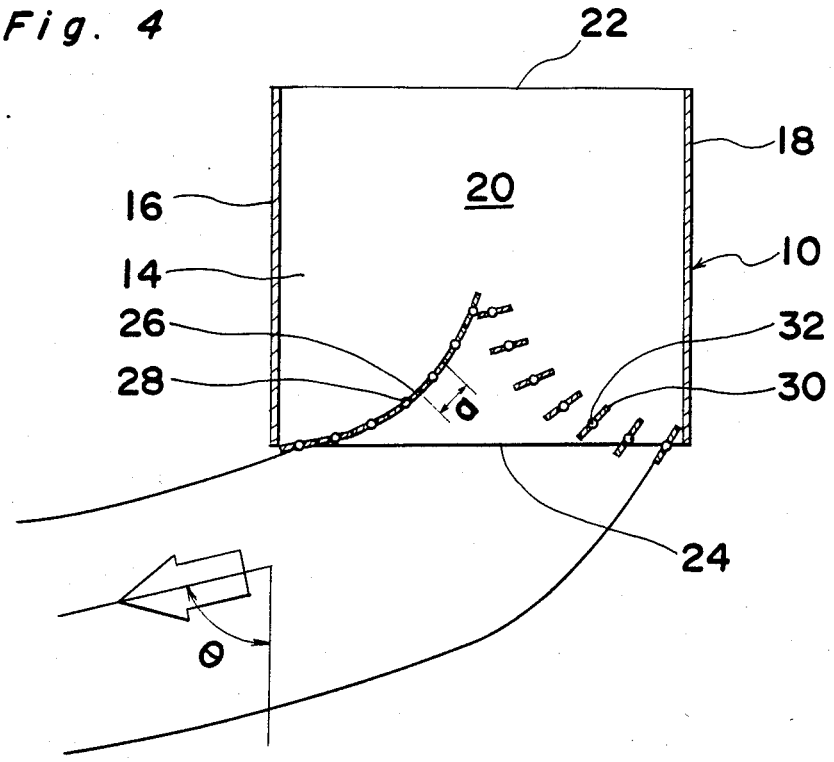
FIGS. 4 and 5 are schematic top sectional views of the fluid deflecting assembly of FIG. 1, showing deflector blades in different positions, respectively.
Figure 5:
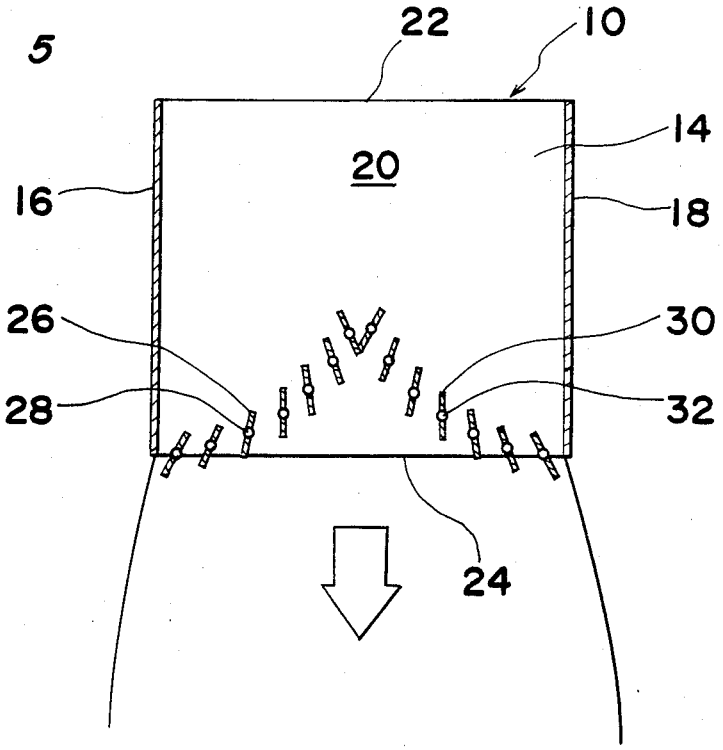
Figure 10:
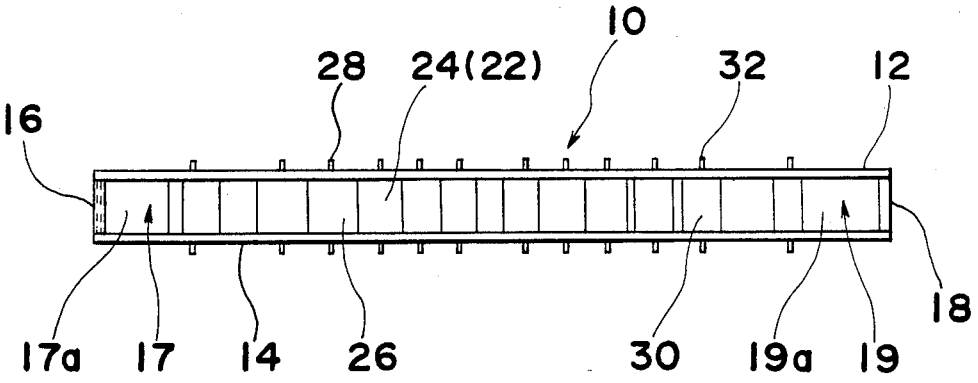
FIG. 10 is a front elevational view of the fluid deflecting assembly shown in FIGS. 9, 11 and 12.

Referring first to FIGS. 3 to 5, the passage defining structure 10 may be of a construction identical with that shown in FIGS. 1 and 10 and has left-hand and right-hand groups of deflector blades 26 and 30 operatively installed within the passage defining structure 10 adjacent the fluid exit 24 in respective curved rows. Although not shown, the passage defining structure 10 is to be understood as installed on the path of flow of a forced draft of air so that a stream of air can flow through the passage 20 within the structure 10 in one direction from the fluid inlet 22 towards the fluid exit 24.

These deflector blades 26 and 30 are pivotable in the same direction between first and second positions past an intermediate position together with associated spindles 28 and 32 which are, while extending at right angles to the direction of flow of the air stream through the passage 20, journalled at their opposite ends to the top and bottom walls 12 and 14. The left-hand and right-hand groups of the deflector blades 26 and 30 are so arranged in respective rows that, when the left-hand and right-hand groups of the deflector blades 26 and 30 are simultaneously pivoted to any one of the first and second positions, one of the left-hand and right-hand rows of the deflector blades 26 and 30 can form a generally continuously curved guide walls, which extends in the passage 20 so as to diverge outwardly away from the direction of flow of the air stream towards the fluid exit 24, while the other of the left-hand and right-hand rows of the deflector blades can be held in position to deflect the air stream in a direction generally conforming to the curvature of the curved guide wall. By way of example, FIG. 4 illustrates the condition in which the left-hand and right-hand rows of the deflector blades 26 and 30 are pivoted to the first position, in which condition the left-hand row of the deflector blades 26 form the generally continuously curved guide wall while the right-hand row of the deflector blades 30 are held in position to deflect the air stream in a direction generally conforming to the curvature of the curved guide wall. Thus, it will readily be seen that the spindles 28 for the left-hand row of the deflector blades 26 and the spindles 32 for the right-hand row of the deflector blades 30 are so arranged and so positioned that the imaginary lines extending perpendicular to and connecting spindles 28 and 32 for the left-hand and right-hand rows of the deflector blades 26 and 30, respectively, can extend towards the fluid exit 24 so as to diverge away from each other.

The width a of each of the deflector blades 26 and 30 is so selected that no gap will be formed between each adjacent two of the deflector blades 26 or 30 then held in the first or second position forming the generally continuously curved guide wall. For this purpose, the width a may be greater than the distance between each adjacent two spindles 28 or 32. Where the spindles are not equally spaced, the sum of the width of a portion of each deflector blade on one side of the associated spindle and that of the adjacent portion of the next adjacent deflector blade may be selected to be greater than the distance between the neighboring spindles. In any event, in the instance so far shown, the spindles 28 and 32 are equally spaced from each other while the deflector blades 26 and 30 have an equal width a which is equal to the distance between each adjacent two spindles so that, when in the first or second position, the deflector blades 26 or 30 can be contiguous to each other so as to form the continuously curved guide wall.

In the instance shown in FIGS. 4 and 5, the left-hand and right-hand rows of the deflector blades 26 and 30 are shown as pivotable simultaneously through an equal angle between the first and second positions. This can readily be accomplished by the employment of a most simplified drive linkage system (not shown). However, by suitably designing the drive linkage system, it is possible to drive the deflector blades in a manner that enables them to exhibit an efficient fluid deflecting capability.

The fluid deflecting assembly of the construction shown in and described with reference to FIGS. 3 to 5 operates in the following manner. Assuming that the left-hand and right-hand rows of the deflector blades 26 and 30 are held in the first position as shown in FIG. 4, in which condition the left-hand row of the deflector blades 26 forms the curved guide wall, the air stream flowing through the passage 20 from the fluid inlet 22 towards the fluid exit 24 is deflected leftwards by the action of the right-hand row of the deflector blades 30. The air stream so deflected is subsequently attached to the curved guide wall then delimited by the left-hand row of the deflector blades 26 and is further deflected leftwards by the Coanda effect as it separate away from the curved guide wall, exhibiting the deflecting angle $\theta$ greater than that afforded by the prior art fluid deflecting assembly. In this condition, although a left-hand half of the passage 20 is blocked by the left-hand row of the deflector blades 26 then forming the curved guide wall, the reduction in flow of the air emerging outwardly from the fluid exit 24 as a whole is smaller than that according to the prior art deflecting assembly because the right-hand row of the deflector blades 30 then held in position to deflect the air stream in a direction generally conforming to the curvature of the curved guide wall provide less resistance to the flow of the air therethrough than in the prior art deflecting assembly.

It is to be noted that, except that the air stream is deflected rightwards, the foregoing description is equally applicable even where the left-hand and right-hand rows of the deflector blades 26 and 30 are pivoted to the second position whereat the right-hand row of the deflector blades 30 forms the curved guide wall and the left-hand row of the deflector blades 26 are held in position to deflect the air stream in a direction generally conforming to the curvature of the curved guide wall delimited by the left-hand row of the deflector blades 26.

FIG. 5 illustrates the condition in which the left-hand and right-hand rows of the deflector blades are pivoted from either the first position or the second position to the intermediate position spaced an equal angular distance from any one of the first and second positions. In this intermediate position, the left-hand and right-hand rows of the deflector blades 26 and 30 are held in generally parallel relation to each other and, therefore, the air stream emerging from the fluid exit 24 flows generally straight forwards without being substantially deflected by the deflector blades 26 and 30.

In the practice of the present invention, the drive linkage system is preferably so designed that, during the operation of an air-conditioner incorporating the fluid deflecting assembly according to the present invention, the left-hand and right-hand rows of the deflector blades 26 and 30 can be continuously pivoted between the first and second positions past the intermediate position to permit the air stream emerging outwardly from the fluid exit 24 to swing leftwards and rightwards one at a time with the deflecting angle varying as a function of the angular position of the deflector blades 26 and 30.

Figure 6:
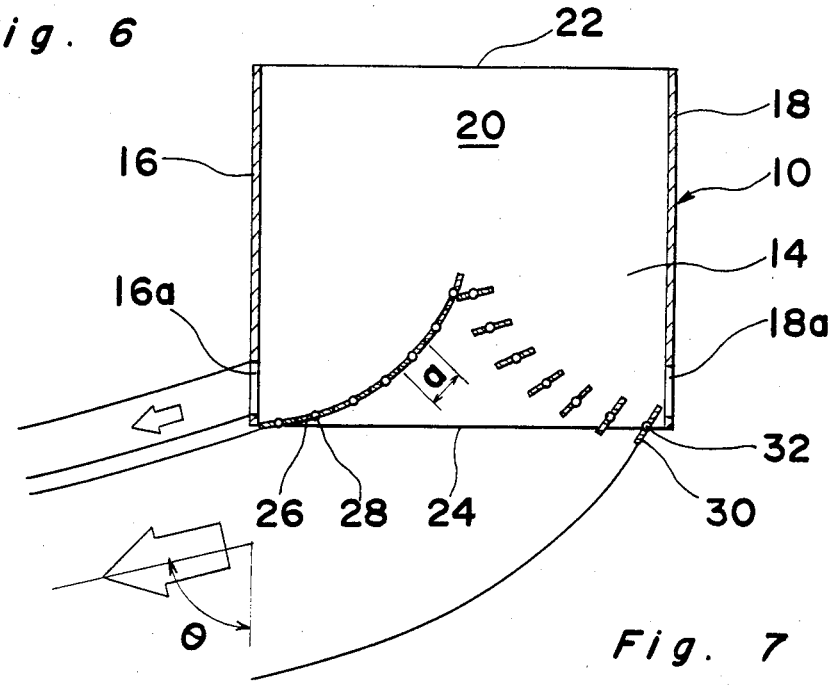
FIGS. 6 and 8 are views similar to FIGS. 4 and 5, respectively, showing the fluid deflecting assembly according to a second preferred embodiment of the present invention.
Figure 7:
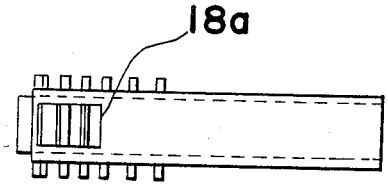
FIG. 7 is a schematic side view of the fluid deflecting assembly shown in FIGS. 6 and 8.
Figure 8:
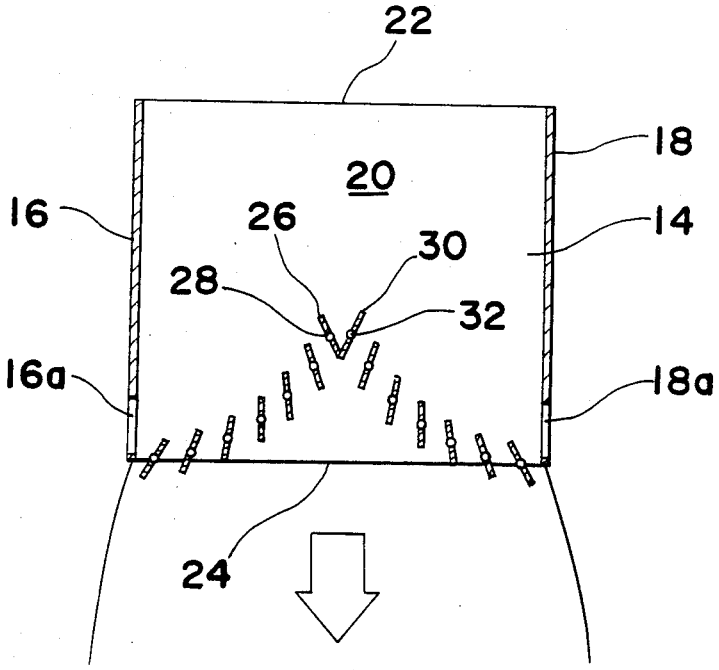

In another embodiment of the present invention shown in FIGS. 6 to 8, the side walls 16 and 18 of the passage defining structure 10 are formed at a portion thereof adjacent the fluid exit 24 with respective lateral openings 16*a* and 18*a*. So far shown in FIG. 6 in which the left-hand row of the deflector blades 26 are shown as forming the curved guide wall, a portion of the air stream impinging upon the left-hand series of the deflector blades 26 blocking the left-hand half of the passage 20 is allowed to emerge outwards through the lateral opening 16*a* after having been deflected by the left-hand row of the deflector blades 26. The flow of the air emerging outwardly from the lateral opening 16*a* does not only minimize the reduction of the flow of the air stream emerging outwardly of the passage defining structure 10 as a whole, but also serve to draw the air stream, then deflected leftwards as it emerges outwards from the fluid exit 24, close towards the flow of the air emerging outwards from the lateral opening 16*a* to further deflect the air stream leftwards with the maximum deflecting angle $\theta$ being consequently increased as compared with that in the fluid deflecting assembly according to the foregoing embodiment.

The foregoing description is equally applicable even when the left-hand and right-hand rows of the deflector blades 26 and 30 are pivoted to the second position in which condition the lateral opening 18*a* takes the place of the lateral opening 16*a* described above.

However, when the left-hand and right-hand rows of the deflector blades 26 and 30 are pivoted to the intermediate position from either one of the first and second positions as shown in FIG. 8, the air stream flows generally straight forwards as it emerges outwards from the fluid exit 24 substantially as is the case with that described with reference to FIG. 5.

It is to be noted that the lateral openings 16*a* and 18*a* may be provided wrth alternately operable lids which open and close the lateral openings 16*a* and 18*a*, respectively, when the left-hand and right-hand rows of the deflector blades 26 and 30 are pivoted to the first position, but close and open the lateral openings 16*a* and 18*a*, respectively, when they are pivoted to the second position.

In a further embodiment of the present invention shown in FIGS. 9 to 12, the passage defining structure 10 is provided with left-hand and right-hand passage constricting members 17 and 19 of generally quadrant cross-sectional shape. Each of these passage constricting members 17 and 19 has a curved face 17*a* or 19*a* and is secured to, or integrally formed with, a portion of the respective side wall 16 or 18 adjacent the fluid exit 24 with the curved face 17*a* or 19*a* confronting with the curved face 19*a* or 17*a* of the other of the passage constricting members. While no lateral opening such as employed in the side walls 16 and 18 in the embodiment shown in and described with reference to FIGS. 6 to 8 is employed in the embodiment shown in FIGS. 9 to 12, the left-hand and right-hand rows of the deflector blades 26 and 30 are so positioned that, when they are pivoted to the first or second position shown in FIG. 9 or FIG. 12, respectively, the space can be formed between tne curved face 17*a* and one of the detlector blades 26 of the left-hand row closest to the fluid exit 24 or between the curved face 19*a* and one or the deflector blades 30 of the right-hand row closest to the fluid exit 24, respectively.

Figure 9:
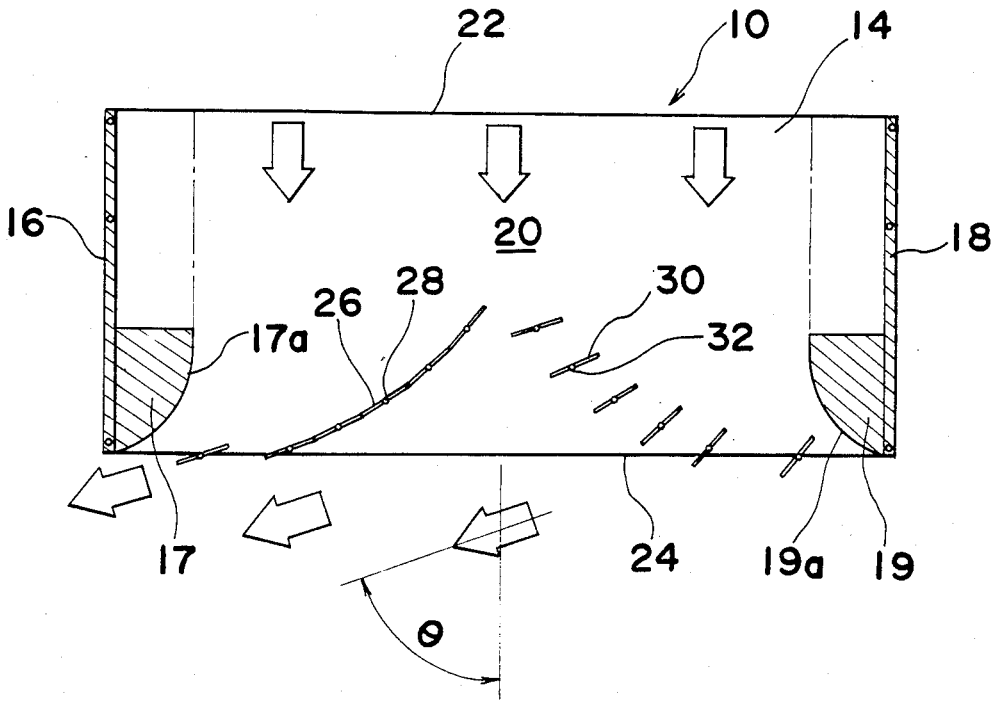
FIGS. 9, 11 and 12 are top sectional views of the fluid deflecting assembly according to a third preferred embodiment of the present invention, with the deflector blades shown in first, intermediate and second positions, respectively.

Thus, in the condition shown in FIG. 9 in which the left-hand and right-hand rows of the deflector blades 26 and 30 are all pivoted to the first position, the fluid stream flowing through the passage 20 towards the fluid exit 24 impinges in part upon the rear side of the curved guide wall then delimited by the left-hand row of the deflector blades 26 and in part upon the right-hand row of the deflector blades 30 then held in position to deflect the air stream in a direction generally conforming to the curvature of the curved guide wall while attaching to the curved guide wall. While that portion of the air stream so deflected by the right-hand row of the deflector blades 30 flows generally leftwards along the curved guide wall accompanied by the wall attachment, that portion of the air stream impinging upon the rear side of the curved guide wall flows along the curved face 17*a* of the left-hand passage constricting member 17 and then emerges outwards through the space between the curved face 17*a* and the deflector blade 26 closest to the fluid exit 24 while drawing the first mentioned portion of the air stream close thereto thereby increasing the maximum available deflecting angle $\theta$.

Figure 11:
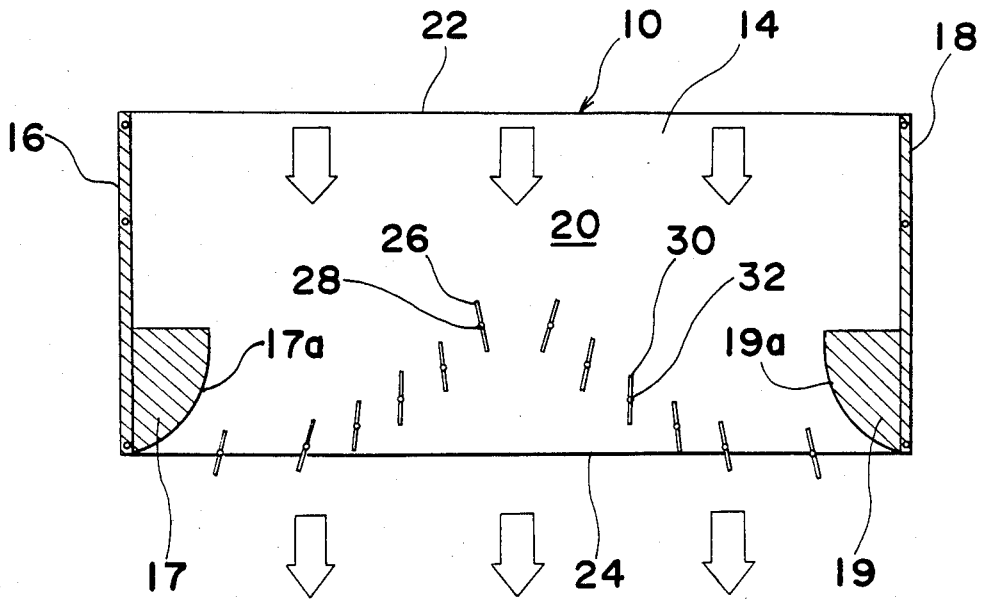
Figure 12:
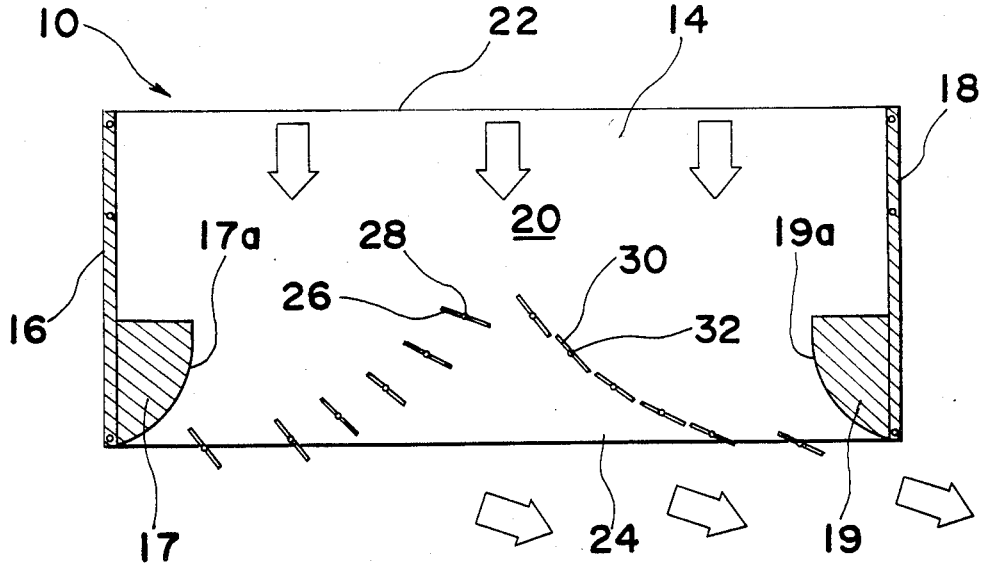

As the left-hand and right-hand rows of the deflector blades 26 and 30 are pivoted from the first position towards the intermediate position the air stream emerging outwards from the fluid exit 24 having been deflected leftwards as shown by the arrows in FIG. 9 swings rightwards and, when they arrive at the intermediate position as shown in FIG. 11, it flows generally straight forwards as shown by the arrows in FIG. 11. The subsequent pivot of the left-hand and right-hand rows of the deflector blades 26 and 30 results in the rightwards deflection of the air stream in a direction generally conforming to the curvature of the curved guide wall then delimited by the right-hand row of the deflector blades 30 as shown in FIG. 12. At this time, the right-hand passage constricting member 19 operates, in a manner similar to the left-hand passage constricting member 17, to the air stream flowing outwards along the curved guide wall while exhibiting the Coanda effect.

The fluid deflecting assembly according to the embodiment shown in and described with reference to FIGS. 9 to 12 is particularly advantageous in that, since the flow of the air stream directed from the fluid inlet 22 towards the fluid exit 24 is substantially accelerated as it passes a portion of the passage 20 constricted by the passage constricting members 17 and 19, the deflection of the air stream in either direction, i.e., leftwards or rightwards can be enhanced and, therefore, the air stream emerging from the fluid exit 24 as a whole can cover a relatively large space to be air-conditioned.

It is to be noted that, in the embodiment shown in FIGS. 9 to 12, although the passage constricting members 17 and 19 have been shown and described as having such a size as to constrict only a downstream portion of the passage 20 adjacent the fluid exit 24, they may be of such a size as to constrict the entire passage 20 as shown by the respective chain lines in Fig. 9. It is also to be noted that, where the entire passage 20 is to be constricted, it can also be accomplished by the employment of the side walls 16 and 18 of such a design that they are, while spaced a distance from each other, outwardly flared in a direction downstream of the passage 20 with respect to the direction of flow of the air stream.

In any one of the foregoing embodiments of the present invention, each of the left-hand and right-hand groups of the deflector blades have been shown and described as arranged in the respective single row. However, in the embodiment shown in FIGS. 13 to 15, each group of the deflector blades comprises inner and outer rows of the deflector blades.

Figure 13:
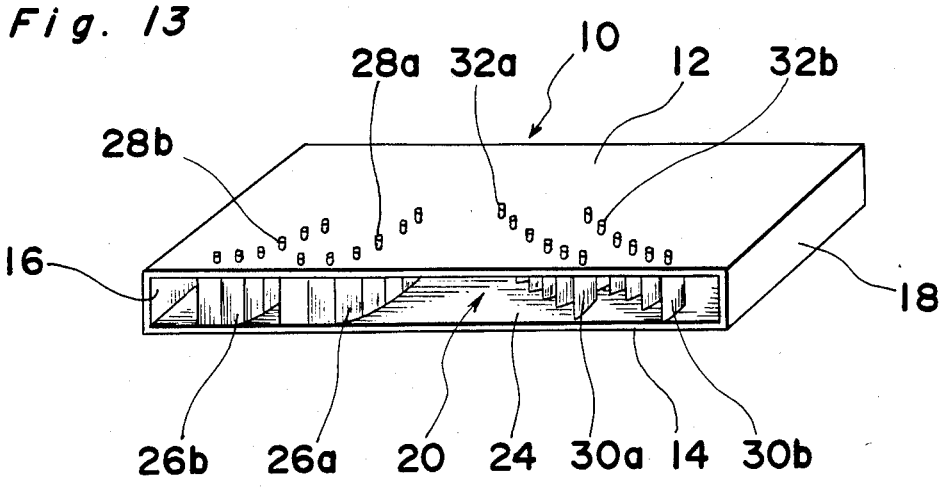
FIG. 13 is a perspective view of the fluid deflecting assembly according to a fourth embodiment of the present invention.
Figure 14:
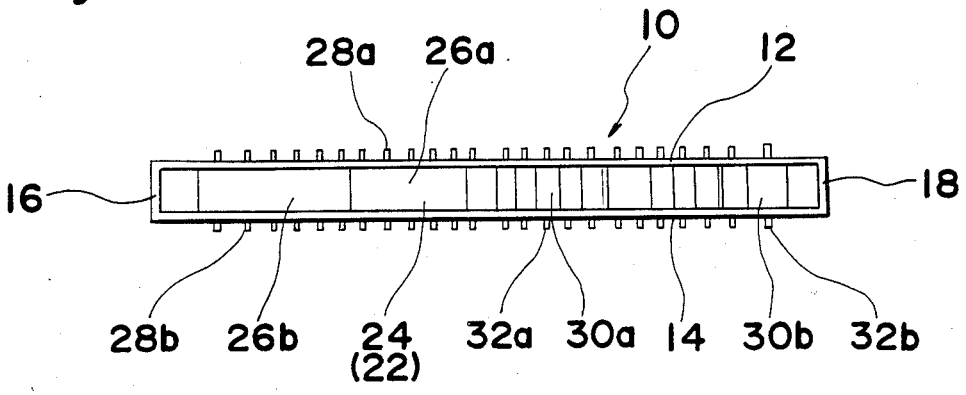
FIG. 14 is a front elevational view of the fluid deflecting assembly shown in FIG. 13.
Figure 15:
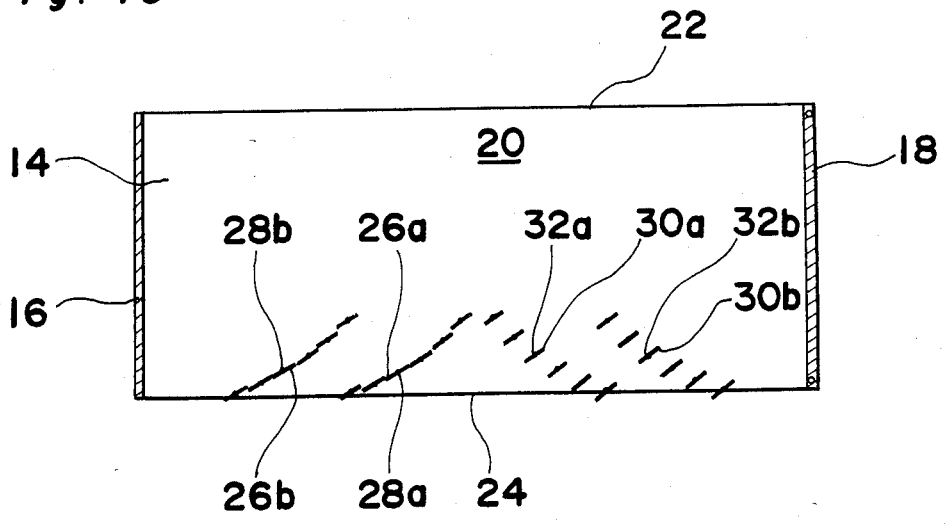
FIG. 15 is a schematic top sectional view of the fluid deflecting assembly shown in FIG. 13.

Referring now to FIGS. 13 to 15, the inner and outer rows of the deflector blades for the left-hand group are respectively identified by 26*a* and 26*b* whereas the inner and outer rows of the deflector blades for the right-hand group are respectively identified by 30*a* and 30*b*. The inner rows of the deflector blades 26*a* and 30*a* extend from a central region of the passage 20 towards the fluid exit 24 so as to diverge away from each other whereas the outer rows of the deflector blades 26*b* and 30*b* are positioned on one side of the inner rows of the deflector blades 26*a* and 30*a* adjacent the respective side walls 16 and 18 and extend so as to diverge away from each other in a manner similar to the inner rows of the deflector blades 26*a* and 30*a*. Reference numerals 28*a* and 28*b* represent spindles for the support of the deflector blades 26*a* and 26*b* and reference numerals 32*a* and 32*b* represent spindles for the support of the deflector blades 30*a* and 30*b*.

All of the spindles 28*a*, 28*b*, 32*a* and 32*b* are drivingly linked together so that, when all of the deflector blades 26*a*, 26*b*, 30*a* and 30*b* are pivoted srmultaneously to the first position, the inner and outer rows of the deflector blades 26*a* and 26*b* of the left-hand group can form generally continuously curved guide walls spaced apart from each other while the inner and outer rows of the deflector blades 30*a* and 30*b* of the right-hand group are held in position to deflect the air stream leftwards as viewed in FIG. 15, but when they are pivoted to the second position, the inner and outer rows of the deflector blades 30*a* and 30*b* of the right-hand group can form generally continuously curved guide walls spaced apart from each other while the inner and outer rows of the deflector blades 26*a* and 26*b* of the left-hand group are held in position to deflect the air stream rightwards. All of the deflector blades 26*a*, 26*b*, 30*a* and 30*b* can assume a generally parallel relation to each other when they are pivoted to the intermediate position, in which condition, the air stream can flow straight forwards as it emerges from the fluid exit 24.

With particular reference to FIG. 15, and assuming that all of the deflector blades 26*a*, 26*b*, 30*a* and 30*b* are pivoted to the first position while the air stream flows through the passage 20 from the fluid inlet 22 towards the fluid exit 24, a portion of the air stream deflected by the inner and outer rows of the deflector blades 30*a* and 30*b* of the rrght-hand group flows in a direction generally conforming to the curvature of the guide wall then delimited by the inner row of the deflector blades 26*a* of the left-hand group while exhibiting the Coanda effect. At the same time, another portion of the air stream entering the space between the spaced apart guide walls then delimited by the inner and outer rows of the deflector blades 26*a* and 26*b*, respectively, of the left-hand group is guided in a direction generally conforming to the curvature of the guide wall, delimited by the outer row of the deflector blades 26*b* of the left-hand group, while exhibiting the Coanda effect and, simultaneously therewith, drawing the portion of the air stream, flowing along the guide wall delimited by the inner row of the deflector blades 26*a* of the left-hand group, to permit it to join the another portion of the air stream, thereby enabling the air stream as a whole to be deflected at a relatively great angle $\theta$ in the leftward direction as viewed in FIG. 5. This is also true even when the deflector blades are all pivoted to the second direction at which time the air stream as a whole is deflected in the rightward direction.

The embodiment shown and described with reference to FIGS. 13 to 15 is particularly advantageous in that the passage defining structure 10 can be constructed to have a relatively short passage 20, as compared with that in any one of the foregoing embodiments, for the same available deflecting angle $\theta$, and that the reduction in flow of the air stream emerging outwards from the fluid exit 24 is advantageously minimized since the guide walls delimited respectively by the inner and outer rows of the deflector blades of either the left-hand group or the right-hand group do not block half of the passage within the passage defining structure.

Although the present invention has fully been described in connection with the preferred embodiments thereof with reference to the accompanying drawings, it is to be noted that various changes and modifications are apparent to those skilled in the art. By way of example, the passage defining structure may not be always provided with the left-hand and right-hand groups of the deflector blades, but may be provided with only one of them.

Accordingly, such changes and modifications are to be understood as included within the scope of the present invention as defined by the appended claims, unless they depart therefrom.

What is claimed is:

1. A fluid deflecting assembly comprising a passage defining structure having a fluid passage defined therein for the passage of a fluid stream in one direction therethrough, said fluid passage having a fluid inlet and a fluid exit spaced apart from the fluid inlet, and at least one group of deflector blades pivotally supported within the passage defining structure adjacent the fluid exit for movement through a predetermined angle and arranged in such a curved row that, when the deflector blades are pivoted in one direction to a deflecting position, said deflecting blades altogether form a generally continuously curved guide wall extending within the passage defining structure so as to diverge away from the direction of flow of the fluid stream through the passage, said guide wall being operable to draw the fluid stream close thereto to deflect the fluid stream as a whole by the Coanda effect known per se as it emerges outwards from the fluid exit.

2. An assembly as claimed in claim 1, wherein each of the deflector blades has a width so selected that the sum of the width of a portion of each deflector blade on one side of the associated axis of pivot thereof and that of the adjacent portion of the next adjacent deflector blade is greater than the distance between the neighboring two axes of pivot of the associated deflector blades.

3. An assembly as claimed in claim 1, wherein the axes of pivot of the respective deflector blades extend in a row from a portion substantially intermediately of the length of the passage towards the fluid exit.

4. A fluid deflecting assembly comprising a passage defining structure having a fluid passage defined therein for the passage of a fluid stream in one direction therethrough, said fluid passage having a fluid inlet and a fluid exit spaced apart from the fluid inlet, and at least one group of deflector blades pivotally supported within the passage defining structure adjacent the fluid exit for movement through a predetermined angle and arranged in such a curved row that, when the deflector blades are pivoted in one direction to a deflecting position, said deflecting blades altogether form a generally continuously curved guide wall extending within the passage defining structure so as to diverge away from the direction of flow of the fluid stream through the passage, said guide wall being operable to draw the fluid stream close thereto to deflect the fluid stream as a whole by the Coanda effect known per se as it emerges outwards from the fluid exit, said passage defining structure also having at least lateral opening defined therein at a location laterally of one of the deflector blades closest to the fluid exit.

5. An assembly as claimed in claim 4, wherein each of the deflector blades has a width so selected that the sum of the width of a portion of each deflector blade on one side of the associated axis of pivot thereof and that of the adjacent portion of the next adjacent deflector blade is greater than the distance between the neighboring two axes of pivot of the associated deflector blades.

6. An assembly as claimed in claim 4, wherein said lateral opening is adapted to be opened when the deflector blades are pivoted to form the curved guide wall.

7. An assembly as claimed in claim 4, wherein the axes of pivot of the respective deflector blades extend in a row from a portion substantially intermediately of the length of the passage towards the fluid exit.

8. A fluid deflecting assembly comprising a passage defining structure having a fluid passage defined therein for the passage of a fluid stream in one direction therethrough, said fluid passage having a fluid inlet and a fluid exit spaced apart from the fluid inlet, and at least one group of deflector blades pivotally supported within the passage defining structure adjacent the fluid exit for movement through a predetermined angle and arranged in such a curved row that, when the deflector blades are pivoted in one direction to a deflecting position, said deflecting blades altogether form a generally continuously curved guide wall extending within the passage defining structure so as to diverge away from the direction of flow of the fluid stream through the passage, said guide wall being operable to draw the fluid stream close thereto to deflect the fluid stream as a whole by the Coanda effect known per se as it emerges outwards from the fluid exit, said passage defining structure also having at least one passage constricting member provided on a wall of the passage defining structure at a location adjacent the fluid exit for enhancing the Coanda effect independently of the Coanda effect exhibited by the curved guide walls delimited by the deflector blades.

9. An assembly as claimed in claim 8, wherein the axes of pivot of the respective deflector blades extend in a row from a portion substantially intermediately of the length of the passage towards the fluid exit.

10. An assembly as claimed in claim 8, wherein each of the deflector blades has a width so selected that the sum of the width of a portion of each deflector blade on one side of the associated axis of pivot thereof and that of the adjacent portion of the next adjacent deflector blade is greater than the distance between the neighboring two axes of pivot of the associated deflector blades.

11. A fluid deflecting assembly comprising a passage defining structure having a fluid passage defined therein for the passage of a fluid stream in one direction therethrough, said fluid passage having a fluid inlet and a fluid exit spaced apart from the fluid inlet, and a pair of groups of deflector blades pivotally supported within the passage defining structure adjacent the fluid exit for simultaneous movement through a predetermined angle, each of said groups of the deflector blades being arranged in such at least one curved row that, when the deflector blades are pivoted in one direction to a deflecting position, said deflecting blades altogether form a generally continuously curved guide wall, said guide wall being operable to draw the fluid stream close thereto to deflect the fluid stream as a whole by the Coanda effect known per se as it emerges outwards from the fluid exit, the curved guide walls which are delimited respectively by said groups of the deflector blades extending outwardly towards the fluid exit within the passage defining structure so as to diverge away from each other.

12. An assembly as claimed in claim 11, wherein the axes of pivot of the respective deflector blades of each group extend in a row from a portion substantially intermediately of the length of the passage towards the fluid exit.

13. An assembly as claimed in claim 11, wherein each of the deflector blades of each group has a width so selected that the sum of the width of a portion of each deflector blade on one side of the associated axis of pivot thereof and that of the adjacent portion of the next adjacent deflector blade is greater than the distance between the neighboring two axes of pivot of the associated deflector blades.

* * * * *